United States Patent [19]

Eiermann

[11] Patent Number: 5,011,385

[45] Date of Patent: Apr. 30, 1991

[54] BEARING-AND DRIVE ARRANGEMENT OF A ROTARY PISTON INTERNAL COMBUSTION ENGINE

[75] Inventor: Dankwart Eiermann, Weissensberg, Fed. Rep. of Germany

[73] Assignee: Wankel GmbH, Berlin, Fed. Rep. of Germany

[21] Appl. No.: 525,142

[22] Filed: May 17, 1990

[30] Foreign Application Priority Data

Sep. 7, 1989 [DE] Fed. Rep. of Germany ..... 3929813
Feb. 19, 1990 [DE] Fed. Rep. of Germany ..... 4005023

[51] Int. Cl.[5] ..... F01C 21/08; F02B 55/02

[52] U.S. Cl. ..... 418/61.2; 384/385; 475/162; 29/888

[58] Field of Search ..... 418/61.2; 384/384, 385, 384/337, 342; 475/162; 29/888

[56] References Cited

U.S. PATENT DOCUMENTS 3,461,848 8/1969 Bensinger ..... 418/61.2
3,469,505 9/1969 Bensinger ..... 418/61.2
3,728,943 3/1989 Sutter ..... 418/61.2

*Primary Examiner*—Leonard E. Smith
*Assistant Examiner*—David L. Cavanaugh
*Attorney, Agent, or Firm*—Robert W. Becker & Associates

[57] ABSTRACT

A bearing arrangement and drive transmission arrangement of a rotary piston internal combustion engine having trochoidal-shaped casing mantle raceway surfacing and having a triangular piston controlled by a synchronous drive transmission consisting of a hollow gear and a pinion, with which the teeth of the hollow gear are machined or worked out of a piston bore extending over the entire width by impact pushing/cutting and broaching. A further bore is concentrically provided in the piston bore and extends from a side remote from the synchronous drive transmission as far as to the hollow gear and of which teeth only tooth butt ends are left standing upon which a bearing sleeve of the eccentric bearing is pressed thereon. Cooling passages or channels result between the bearing sleeve and the tooth butt ends. Transfer of contact heat from the piston onto the eccentric bearing is considerably reduced by engagement of the bearing sleeve only upon the tooth butt ends.

7 Claims, 4 Drawing Sheets

BEARING-AND DRIVE ARRANGEMENT OF A ROTARY PISTON INTERNAL COMBUSTION ENGINE

BACKGROUND OF THE INVENTION

1. Field of the Invention

The present invention relates to a rotary piston internal combustion engine with a housing consisting of two side parts and a casing mantle part having a dual-arc trochoidal-shaped casing mantle runway inner surfacing. The housing has an eccentric shaft that passes axially therethrough and is mounted or journalled by the two side parts. An eccentric upon the eccentric shaft has a triangular piston thereon controlled by a synchronous drive transmission with corners of the triangular piston in continuous engagement as sliding along the casing mantle runway inner surfacing. The synchronous transmission consists of a hollow gear stationary on the piston and the pinion stationary in one side part located concentrically around the eccentric shaft.

2. Description of the Prior Art

The hollow gear of the synchronous transmission drive is conventionally connected with the piston by screw threads, pressure welding or pressing-in. The piston and hollow gear consist of materials having different characteristics. In order to take up the impact loads thereon, which arise during pressure reversal in the working chambers, especially upon encountering the combustion cycle with internal combustion engines, there were also proposed elastic connections between the hollow gear and piston, for example via sleeve springs installed in aligned bores in the piston and hollow gear. These arrangements respectively required a considerable production or finishing and assembly cost and complexity and consequently must be considered to be unsuitable and not adapted for inexpensive mass production most of all as to small series machines. The heat loading of the piston via the combustion procedures results in a further constructive problem, both with different materials for the hollow gear and piston as most of all with the eccentric bearing of which the bearing sleeve on the entire outer surfacing thereof is subjected to the contact heat of the piston. The bearing however cannot be permitted to be heated-up or warmed to the conversion- or destruction or disintegration temperatures of the lubricating oil, which most of all is critical with roller bearings, which are not cooled by the lubricating oil flowing therethrough as with slide bearings.

SUMMARY OF THE INVENTION

An object of the present invention accordingly is to take into consideration the two aforementioned problems to provide an eccentric bearing arrangement and hollow gear arrangement which can be produced and manufactured in a simple and straight forward manner requiring only a few working steps, which avoids the different heat distortions of the piston and hollow gear due to the different materials, and which reduces the heat contact between the piston and the eccentric bearing as far as possible.

BRIEF DESCRIPTION OF THE DRAWINGS

This object and other objects and advantages of the present invention, will appear more clearly from the following specification in conjunction with the accompanying drawings, in which.

DESCRIPTION OF PREFERRED EMBODIMENTS

Figure 1:
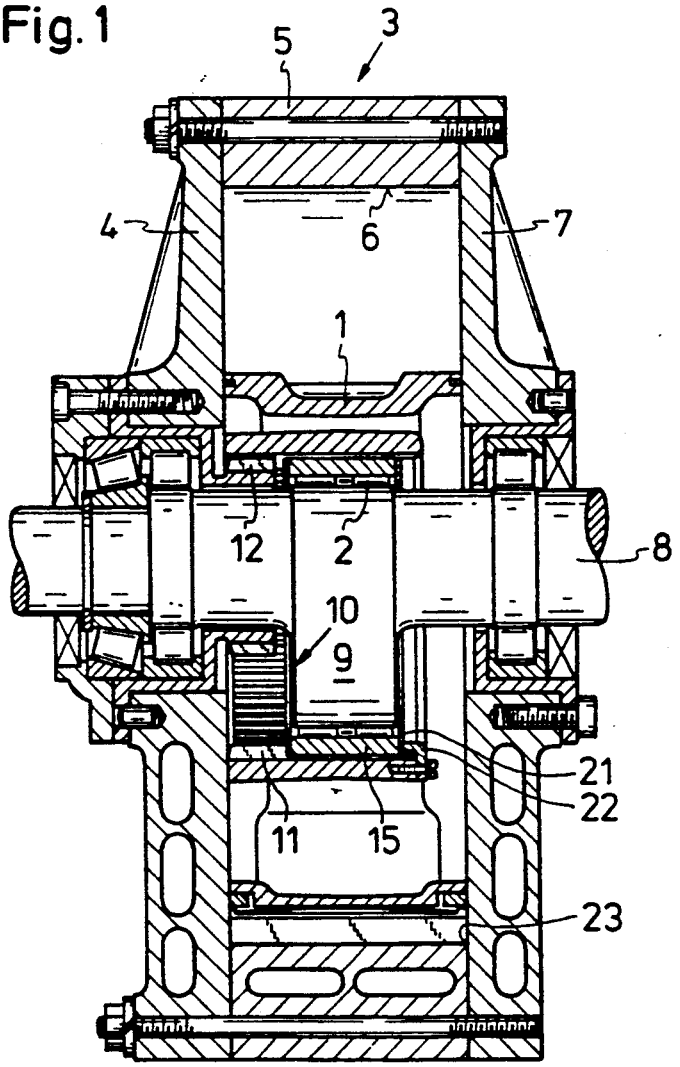
FIG. 1 is a view that shows an axial section through a rotary piston internal combustion engine having a bearing arrangement and transmission drive arrangement with features according to the present invention.

Referring now to the drawings in detail, FIG. 1 shows an internal combustion engine having a mixture cooled piston 1 and a roller bearing 2 as well as a liquid or water cooled housing 3. This housing 3 consists of one side part 4 at the left, a casing mantle part 5 with a trochoidal-shaped dual-arc casing mantle raceway or runway inner surfacing 6 and a second or further side part 7 shown at the right in the illustration of FIG. 1. An eccentric shaft 8 is journalled in the side parts 4 and 7 and has an eccentric 9 thereon upon which the piston 1 rotates upon the roller bearing 2. Between the right side part 7 and the piston 1 there is provided a synchronous transmission drive means 10 which is formed of a hollow gear 11 stationary in the piston 1 and a pinion or a gear means 12 stationary in the left side part 4 and located around the eccentric shaft 8.

Figure 2:
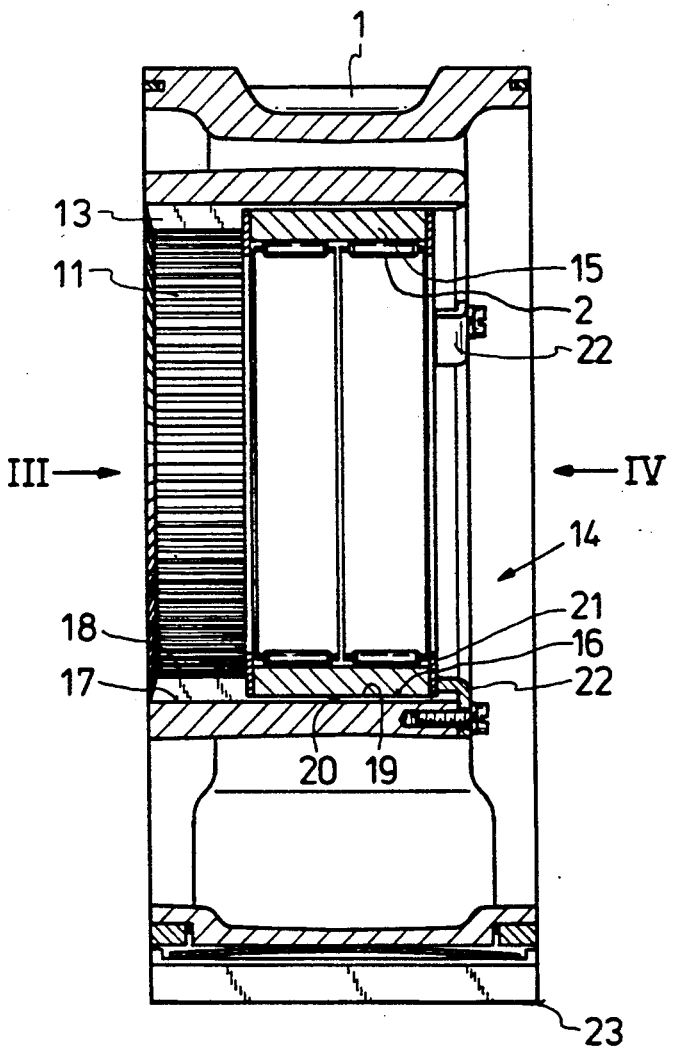
FIG. 2 is a view that shows an enlarged illustration of the piston of the rotary piston internal combustion engine illustrated in FIG. 1 with the roller bearings installed therewith and shown in an axial section.
Figure 3:
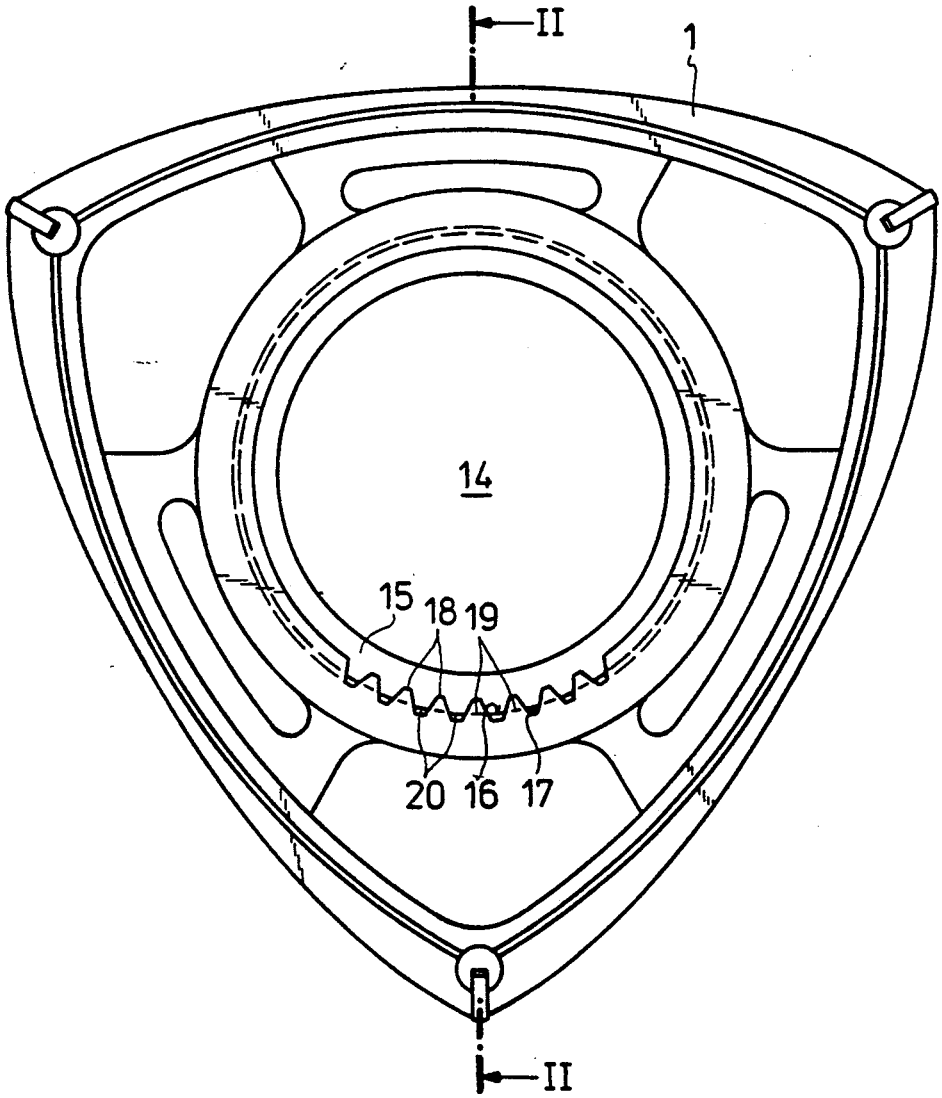
FIG. 3 is a view that shows an axial plan view upon the piston according to FIG. 1 in a direction of the arrow of III in FIG. 2.
Figure 4:
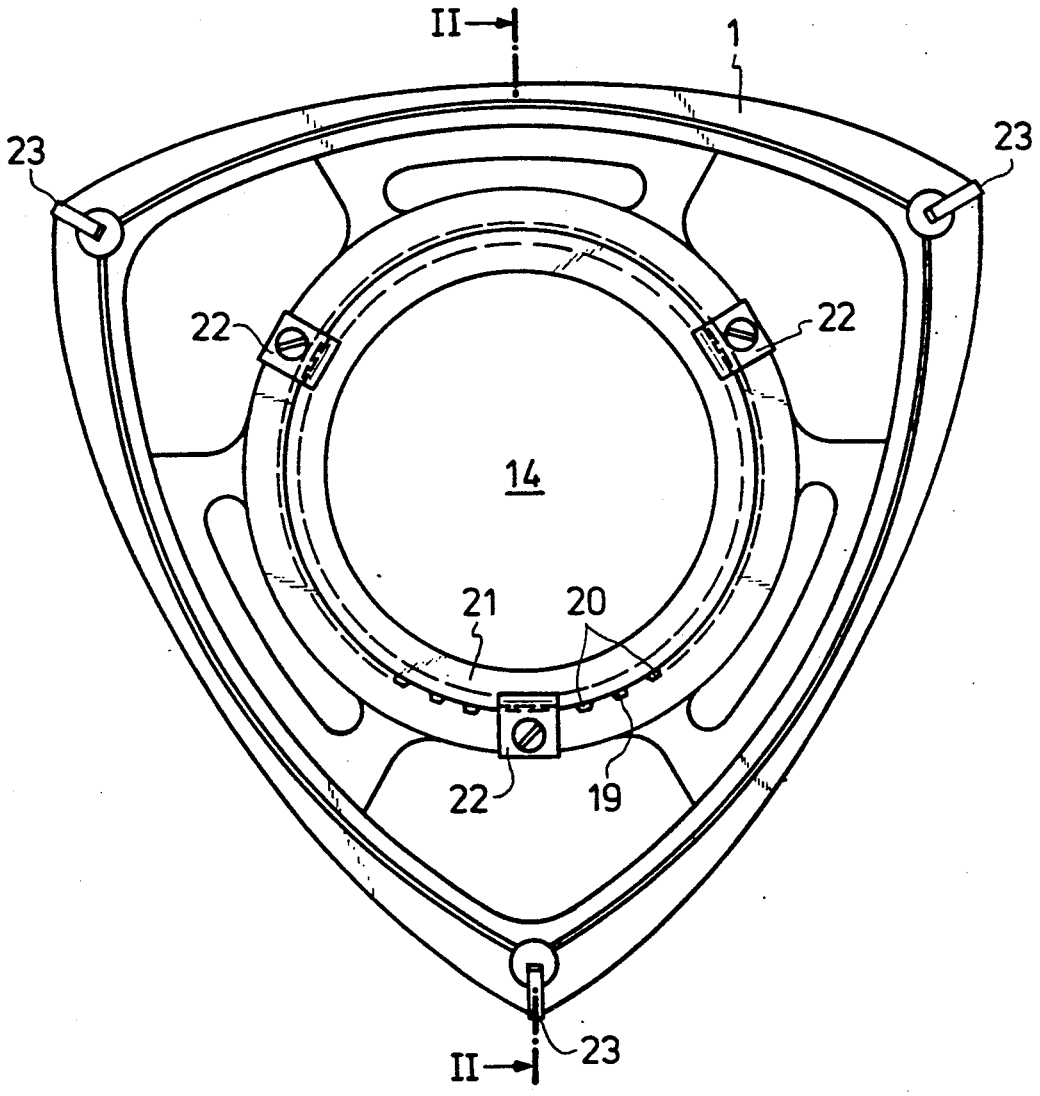
FIG. 4 is a view that shows an axial plan view upon the piston according to FIG. 1 in a direction of the arrow IV in FIG. 2.

The tooth means 13 of the hollow wheel or gear 11 extends over the entire width of the piston 1 from the bearing bore 14 thereof, for example being worked out by pushing, striking, ramming or cutting or broaching. A further bore 16 is provided concentrically to the hollow gear or wheel 11 extending from the right side of the piston 1 as seen in FIGS. 1 and 2 and resulting in a seat of the bearing sleeve 15 of the roller bearing 2 extending as far as to the tooth means 13 of the hollow gear 11 left standing or stationary; the outer diameter of the further bore 16 is located between the tooth bases 17 and the tips 18 of the teeth 13, so that in the region of the roller bearing 2, this tooth means 13 is removed or cut away as far as to a spacing for example of half the tooth height as far as to the tooth base 17 and tooth butt ends 19 that are truncated upon which the bearing sleeve 15 is pressed-in although leaving the tooth means 13 of the hollow gear 11 standing or remaining therewith. This bore 16 also can be brought into being before machining or working out of the tooth means 13 so that then for cutting or broaching only as to the complete tooth means of the hollow gear 11, otherwise however only the tooth butt ends 19 being involved so that less mass or volume must be removed or cut away from the bore 16. Channels or passages 20 formed by the tooth butt ends 19 result after insertion of the bearing sleeve 15 surrounding such structure.

For the purpose of securing the bearing sleeve 15 against axial shifting or displacement there is provided a spring or snap ring 21 upon a right side thereof as seen in FIGS. 1 and 2; this spring or snap ring 21 has an edge that engages upon the tooth butt ends 19 which project or extend to the right over the bearing sleeve 15. This spring or snap ring 21 accordingly leaves the axial passages or channels 20 open. The spring or snap ring 21 is held by three angled-off or bent-away flaps or tongues 22 which are screwed or threaded in the piston 1 along an edge of a further bore 16. The flaps or tongues 22 must have equal spacing from each other in order to be compensated or balanced, balanced-out or counter balanced. Since the flaps or tongues 22 have a foot or base thereof engaging upon the spring or snap ring 21 so as to cover individual passages or channels 20, it is expedient and purposeful to arrange the flaps or tongues 22 in the region of the piston corners 23 accordingly being located respectively in the coolest zone or region.

For mass production of pistons with which no thought is given as to subsequent removal of the bearing 2, the spring or snap ring 21 can be pressed or fitted into a groove in the further bore 16. The spring or snap ring 21 must however then itself have openings of a tooth means oriented or in alignment with the passages or channels 20 in order to avoid covering or obstructing these channels or passages 20.

The construction of the passages or channels 20 can be considered to have a purpose on the one hand to reduce transfer of contact heat conveyed from the combustion chambers via the piston via reduction of the contact surfaces between the piston and the bearing sleeve to an amount of approximately one third. On the other hand, the channels or passages 20 just like the piston 1 itself have cooling that occurs via fuel-air mixture suctioned respectively by suction air flowing therethrough with which the roller bearing 2 is effectively cooled.

In conclusion, the bearing arrangement and transmission or driver arrangement of the rotary piston internal combustion engine includes a housing consisting of two side parts and a casing mantle part with dual-arc trochoidal-shaped inner raceway surfacing. The eccentric shaft extends axially through the housing and is journalled by the two side parts. A triangular piston controlled by a synchronous drive transmission means is provided on the eccentric and corners of the triangular piston engage or slide along the casing mantle raceway surfacing continuously, whereby the synchronous transmission drive consists of a hollow gear stationary on the piston and a pinion stationary in one side part and located concentrically around the eccentric shaft. The tooth means 13 of the hollow gear 11 is machined or worked out from the bearing bore 14 and a further bore 16 is brought about or introduced concentrically in the bearing bore 14 from the side over the piston 1 remote or away from the synchronous drive transmission means 10 as far as to the hollow gear 11. The diameter between the tooth tips 18 and the tooth bases 17 is located so that tooth butt ends 19 remain standing upon which the bearing sleeve 15 is installed or inserted and channels or passages 20 result between the bearing sleeve 15, the tooth butt ends 19 and the tooth bases 17. The further bore 16 is introduced before machining or working out the tooth means 13. The tooth butt ends 19 have half the height or up to two-thirds of the height or elevation of the tooth means 13 of the hollow gear 11. The tooth means 13 of the hollow gear 11 is made by pushing, impacting or cutting or broaching. The bearing sleeve 15 is secured against axial shifting or displacement by a spring or snap ring 21 upon a side thereof remote from the synchronous drive transmission means 10. Flaps or tongues 22 are provided for fastening of the spring or snap ring 21 engaging with an edge thereof on the tooth butt ends 19 as to the piston 1 in the region of the corners 23 thereof. The spring or snap ring 21 is pressed into a continuous, rotary groove in the further bore 16 and has a tooth means oriented or in alignment with the channels or passages 20 along an edge thereof.

The present invention is, of course, in no way restricted to the specific disclosure of the specification and drawings, but also encompasses any modifications within the scope of the appended claims.

What I claim is:

1. A bearing- and transmission drive arrangement of a rotary piston internal combustion engine having a housing consisting of two side parts and a casing mantle part with a dual-arc trochoidal-shaped casing mantle inner raceway surfacing as well as having an eccentric shaft that passes axially through the housing and that is journalled by the two side parts as well as including an eccentric upon the eccentric shaft upon which a triangular piston controlled by a synchronous transmission drive means has corners of the triangular piston sliding with continuous engagement along the casing mantle raceway inner surfacing and with which the synchronous drive transmission means consists of a hollow gear fixed stationary on the piston and a pinion fixed stationary in a side part and located concentrically around the eccentric shaft, the improvement comprising:

a tooth means of the hollow gear worked out of a bearing bore; a further bore means provided concentrically in the bearing bore extending from a side of the piston remote from the synchronous drive transmission means as far as to a hollow gear; said tooth means having a diameter located between tooth tips and tooth bases so that tooth butt ends remain; and a bearing sleeve 15 inserted upon the tooth butt ends so that passages result between the bearing sleeve, the tooth butt ends and the tooth bases.

2. An arrangement according to claim 1, in which said further bore means is provided prior to said tooth means being worked out.

3. An arrangement according to claim 1, in which said tooth butt ends have a height in a range between half the height and up to two thirds of the height of the tooth means of the hollow gear.

4. An arrangement according to claim 1, in which said tooth means of the hollow gear is worked out by impact/cutting thereof.

5. An arrangement according to claim 1, in which a spring-snap ring means secures said bearing sleeve against axial shifting and displacement on a side thereof remote from the synchronous drive transmission means.

6. An arrangement according to claim 5, in which tongue means are provided for fastening of the spring-snap ring engaging with an edge thereof against the tooth butt ends in location of corners of said piston.

7. An arrangement according to claim 5, in which a continuous rotary groove is provided in said further bore and into which said spring-snap ring is pressed and on an edge having teeth oriented in alignment with the passages.

* * * * *